US007413103B1

(12) United States Patent
Ho et al.

(10) Patent No.: US 7,413,103 B1
(45) Date of Patent: Aug. 19, 2008

(54) DRY FIRING PREVENTION DEVICE FOR NAIL GUN

(75) Inventors: Yu-Chuan Ho, Dali (TW); Hsien-Nung Liu, Sindian (TW)

(73) Assignee: Apach Industrial Co., Ltd., Taichung (TW)

( * ) Notice: Subject to any disclaimer, the term of this patent is extended or adjusted under 35 U.S.C. 154(b) by 0 days.

(21) Appl. No.: 11/723,790

(22) Filed: Mar. 22, 2007

(51) Int. Cl.
*B25C 1/04* (2006.01)

(52) U.S. Cl. ..... 227/8; 227/120; 227/142

(58) Field of Classification Search ..... 227/8, 227/119, 120, 142, 135, 136, 127, 130
See application file for complete search history.

(56) References Cited

U.S. PATENT DOCUMENTS 5,385,286 A * 1/1995 Johnson, Jr. ..... 227/8
5,715,982 A * 2/1998 Adachi ..... 227/8
6,024,267 A * 2/2000 Chen ..... 227/8
6,170,729 B1 * 1/2001 Lin ..... 227/8
6,427,896 B1 * 8/2002 Ho et al. ..... 227/142
6,581,815 B1 * 6/2003 Ho et al. ..... 227/142
6,769,193 B1 * 8/2004 Meisner ..... 33/645
6,929,165 B1 * 8/2005 Chen et al. ..... 227/8
7,028,875 B1 * 4/2006 Beville et al. ..... 227/8
7,097,084 B2 * 8/2006 Ho ..... 227/8
7,143,918 B2 * 12/2006 Aguirre et al. ..... 227/8
7,303,103 B2 * 12/2007 Wang ..... 227/8
7,318,546 B2 * 1/2008 Segura et al. ..... 227/142

* cited by examiner

*Primary Examiner*—Scott A. Smith
(74) *Attorney, Agent, or Firm*—Banger Shia

(57) ABSTRACT

The present invention refers to a dry firing prevention device, especially for use in a nail gun with a drawer type magazine, in which the main body of the nail gun is equipped with a safety apparatus and a dry firing prevention device near a trigger. The dry firing prevention device is disposed on the magazine. When a nail pusher pushes nails until where last few nails are left, the nail pusher will contact with one end of the dry firing prevention device and the other end of the dry firing prevention device blocks the safety apparatus, so that the safety apparatus retains in a safety status to prevent the nail gun from dry firing, so as to prolong the lifetime of the nail gun.

19 Claims, 7 Drawing Sheets

DRY FIRING PREVENTION DEVICE FOR NAIL GUN

FIELD OF THE INVENTION

The present invention generally relates to the field of nail guns, and more particularly to a dry firing prevention device for use in nail guns with drawer type magazines.

BACKGROUND OF THE INVENTION

Conventional depth adjusting devices of nail guns are generally installed inside the safety devices, for example, U.S. Pat. No. 6,170,729, U.S. Pat. No. 6,427,896 and US 2003/0019901 disclose that the adjusting devices and the safety devices are disposed on the outside of the barrels. The addition of other adjusting devices makes the whole structures more complicated and limited in stabilization. Besides, it is more inconvenient to make adjustment because of its vicinity to the muzzle of the barrel.

Such structure has shortcomings, such as unstable structure, inconvenience for use and complicated manufacture. Because the safety device is assembled by pieces, an adjustment assembly is additionally attached in the middle thereof, which will cause the safety device to shake while the adjustment assembly acts, so as to make the structure unstable and unable to locate precisely. Besides, the adjustment assembly is near the muzzle, it is unable to make an adjustment by one hand that presses the trigger while use. If it needs to adjust the depth of nailing frequently, which is inconvenient for use. Moreover, the connection between the adjustment assembly, the safety device and the trigger uses corresponding connection structure, it needs to design the corresponding connection structure individually for application of different safety devices and triggers, which is complicate to manufacture.

As for the shortcomings mentioned above, the inventor has a TW Appl. No. 93133904 adjustable safety device approved, which discloses that a main body of a nail gun is equipped with an adjusting assembly and a moving assembly between a trigger and a magazine. One end of an acting piece of the adjusting assembly is connected with the trigger. The acting piece is connected with a supporting piece, and the acting piece and one end of the supporting piece are coupled with a moving piece of the moving assembly. Meanwhile, the moving piece is connected with one end of an interlocking assembly of a safety device via a compressing piece. When adjusting the supporting piece, the distance between the acting piece and the moving piece can be controlled precisely, so as to precisely adjust the depth between the actuation point of the safety device and the muzzle. However this case does not consider that the nail gun is still dry firing while the nail is insufficient, which causes the damage of the structure of the nail gun and the firing device.

SUMMARY OF THE INVENTION

The objective of the present invention is to provide a dry firing prevention device for use with a nail gun with a drawer type magazine, which is equipped with a safety apparatus and a dry firing prevention device between a trigger and a fixed magazine, wherein the dry firing prevention device has an interlocking piece pivotally connected with the magazine, one end of the interlocking piece is pushed by a nail pusher and the other end is inserted into the safety apparatus or the trigger, so that the nail gun will stop firing while the nail is insufficient, so as to protect the driving device and the inner structure of the nail gun from damage.

The other objective of the present invention is to provide a safety apparatus that is disposed between a trigger and a magazine, by cooperating with the dry firing prevention device, the safety apparatus is simplified and the depth between an actuation point and a muzzle is precisely adjusted, in addition, it is easy to operate the trigger and the adjusting assembly by one hand so as to promote the convenience.

Another objective of the present invention is to provide a structure that is simplified and stable. Because the components of the safety apparatus are all formed as one-piece structure and connect each other, which does not affect the structure of the safety apparatus, so as to improve the stabilization of the whole structure of the nail gun. Moreover, the adjusting assembly is near the trigger, so that it can use one hand that press the trigger to adjust the adjusting piece of the adjusting assembly, while it needs to adjust the depth of nailing frequently, which is convenient for use. In addition, the pushing part of the interlocking piece of the dry firing prevention device is able to stop the trigger to fire while the nail is insufficient, so as to protect the driving device and the inner structure of the nail gun from damage, thus, the lifetime of the nail gun can be prolonged. Because the safety apparatus and the dry firing prevention device are all formed as one-piece structure and use elements to simplify the structure, so as to simplify the maintenance and manufacture of the nail gun, then the objective of convenience of maintenance and low cost of manufacture are achieved.

The present invention will become more obvious from the following description when taken in connection with the accompanying drawings that show, for purposes of illustration only, a preferred embodiment in accordance with the present invention.

DETAILED DESCRIPTION OF THE PREFERRED EMBODIMENT

Figure 1:
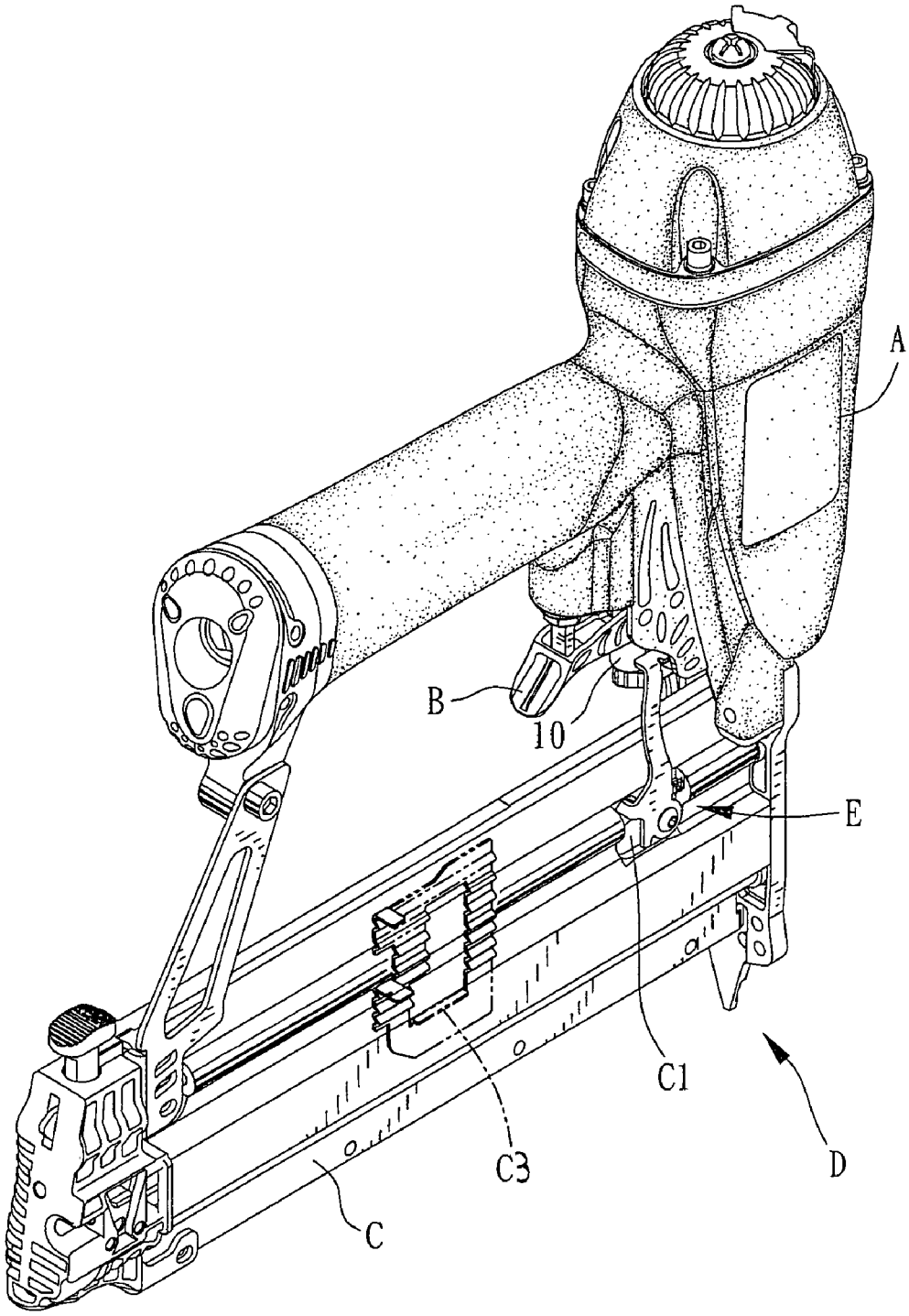
FIG. 1 is a perspective view of the present invention.

Referring to FIG. 1, the present invention refers to a typical nail gun, a main body A of the nail gun is equipped with a safety apparatus D and a dry firing prevention device E between a trigger B and a fixed magazine C. The safety apparatus D includes an adjusting assembly 10 that is disposed near the trigger B and is interlocked by the dry firing prevention device E. The dry firing prevention device E is disposed on a locking area C1 of the fixed magazine C near the trigger B. With the cooperation of the trigger B and the safety apparatus D together with the dry firing prevention device E, when a nail pusher C3 inside a removable nail loading assembly C2 disposed on one side of the fixed magazine C pushes the nails until where last few nails are left, on end of the dry firing prevention device E props against the trigger B so that the trigger B is unable to be pressed to fire the nail. As a result, the inner structure of the nail gun and the firing device can be protected from damage.

Figure 2:
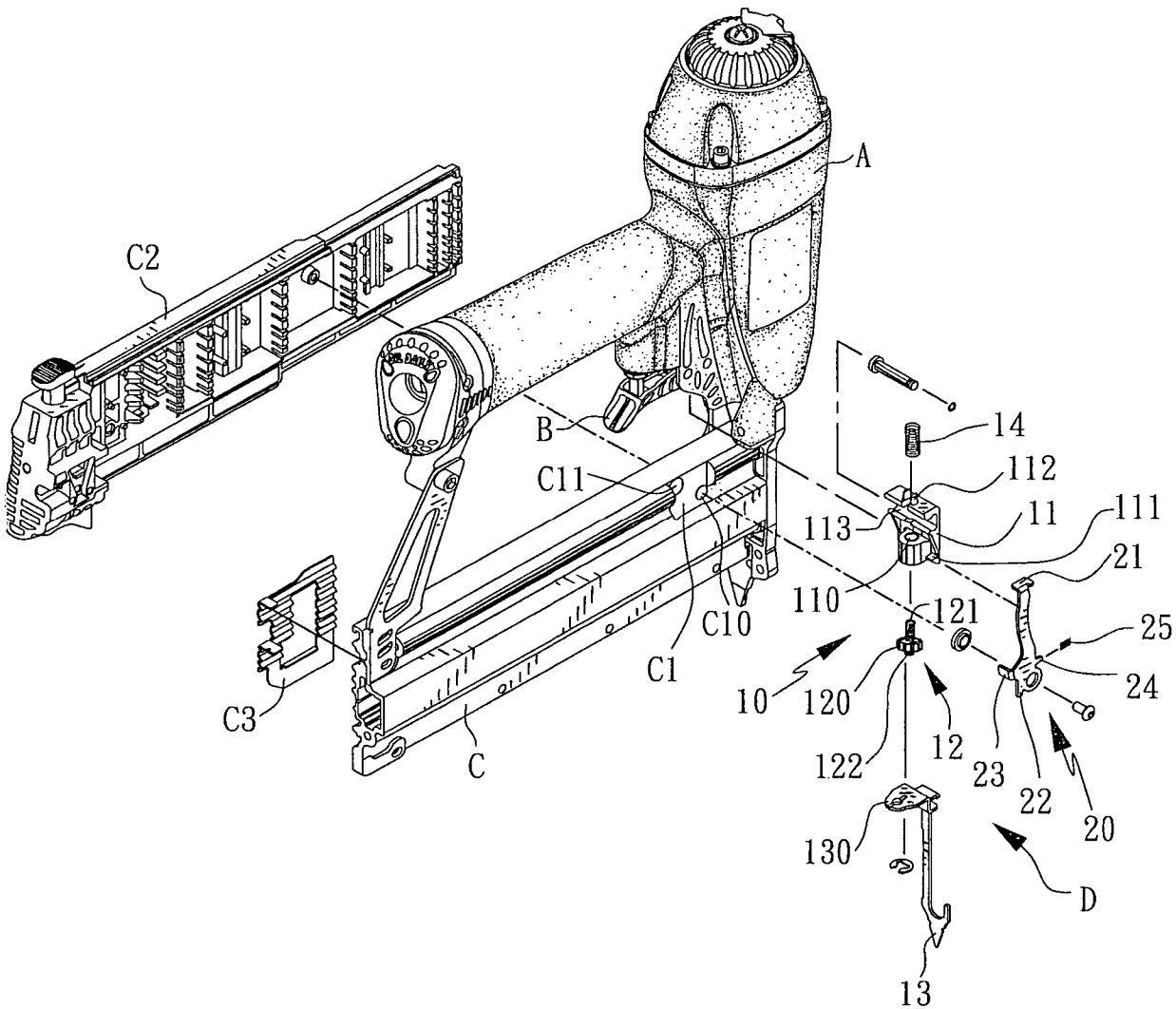
FIG. 2 is a perspective view of the assembly of the present invention.
Figure 3:
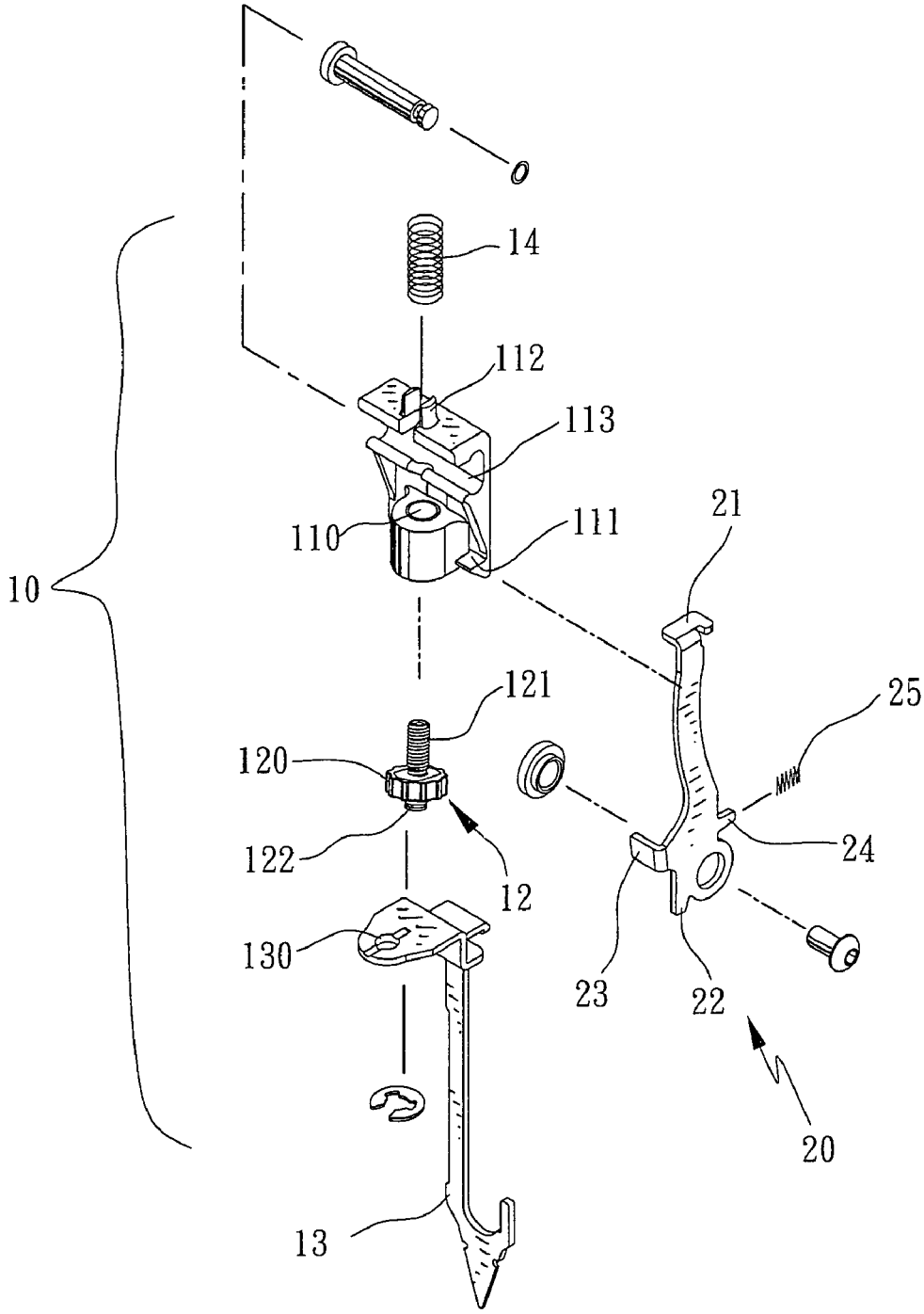
FIG. 3 is an exploded view of the present invention.

Referring to FIGS. 2 and 3, the fixed magazine C includes a locking area C1, a removable nail loading assembly C2 and a nail pusher C3. The locking area C1 is equipped with a threaded hole of fixing part C10 and an engaging hole of receiving part C11 for fixing the dry firing prevention device E. The removable nail loading assembly C2 urges elastically the nail pusher C3 and is engaged with the fixed magazine C.

The adjusting assembly 10 of the safety apparatus D includes an acting piece 11, an adjusting piece 12, a safety piece 13 and a spring of elastic piece 14. The acting piece 11 has a cylindrical threaded locking part 110 with thread inside for receiving the adjusting piece 12, two lateral setting parts 111 in the shape of triangle for engaging with one end of the dry firing prevention device E, an inserting end 112 that is disposed at the other end from the setting parts 111 and cut in the center for insertion of the elastic piece 14, and a C-shaped penetrating part 113 disposed between the inserting part 112 and the threaded locking part 110. The acting piece 11 is locked in position near the trigger B by a fastener 15 received through the penetrating part 113.

The adjusting piece 12 includes an adjusting element 120, a threaded part 121 and a locking part 122. The adjusting element 120 is a round gear wheel, in which the threaded part 121 is installed in the center. The location of the adjusting element 120 can be adjusted with cooperation of the threaded part 121. The threaded part 121 would match in thread with the threaded locking part 110 of the acting piece 11. The locking part 122 that has surrounding groove would penetrate through the safety piece 13.

The safety piece 13 is unitarily formed in the shape of L, which has a round aperture 130 disposed on the top end thereof for receiving the locking part 122 of the adjusting piece 12 that is locked by a C-shaped locking element 16.

The dry firing prevention device E, which has an interlocking piece 20 that is unitarily formed in the shape of a dolphin, is pivotally connected to the fixing part C10 inside the locking area C1 of the fixed magazine C. The interlocking piece 20 includes a hooking part 21, a retaining part 22, a pushing part 23 and a protruding part 24. The hooking part 21 is a lateral plate and able to hook with one of the setting parts 111 of the adjusting assembly 10. The retaining part 22 is propped against the fixed magazine C to retain the position of releasing the adjusting assembly 10. The pushing part 23, which is a lateral plate, is inserted into the receiving part C11 of the fixed magazine C and able to be pushed by the nail pusher C3. The protruding part 24 is inserted into a spring of elastic element 25, which is compressed against the fixed magazine C to enable the interlocking piece 20 to have a prestressing force, so as to retain the position of releasing the adjusting assembly 10.

Figure 4:
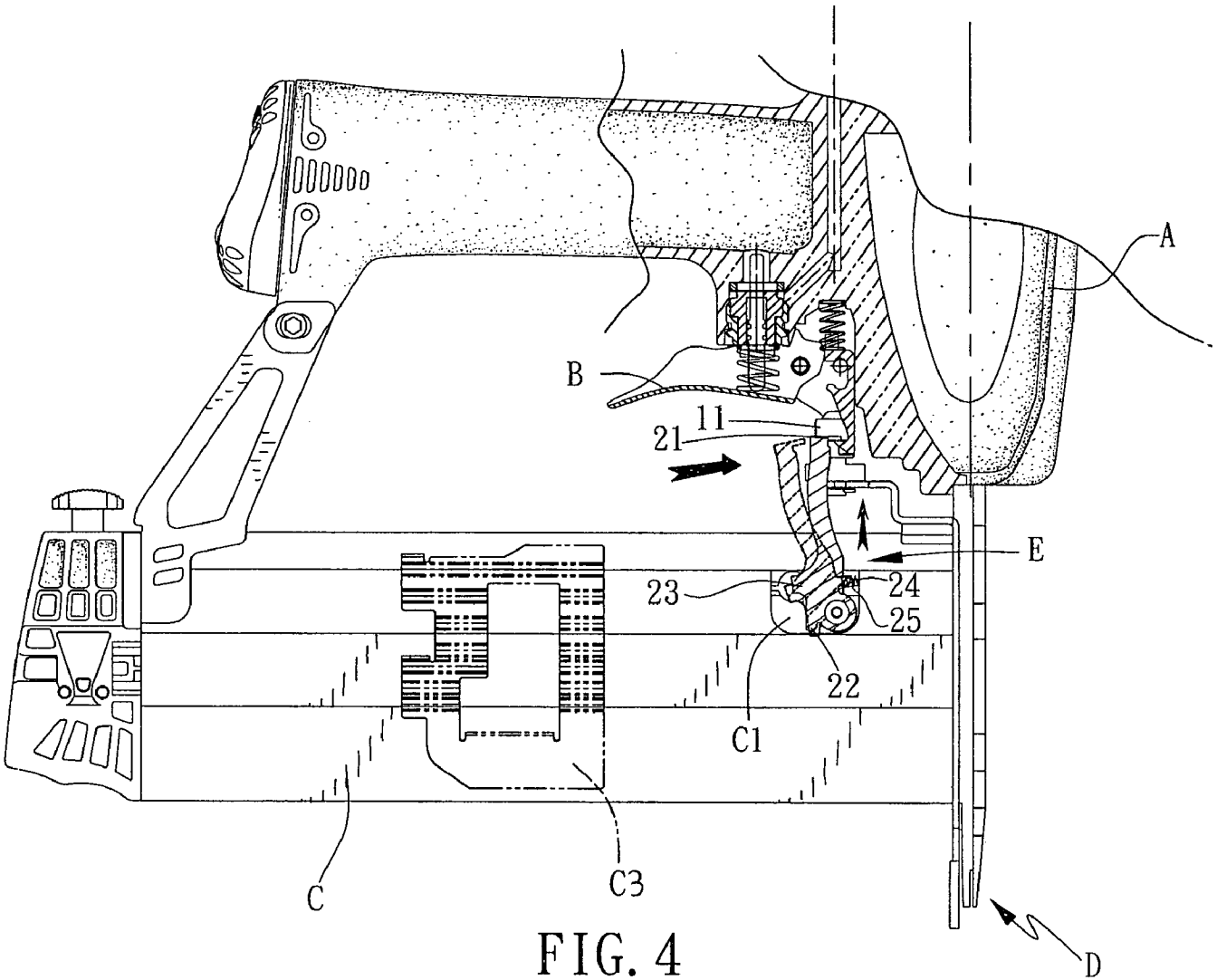
FIG. 4 is a plan view showing the motion of the present invention.
Figure 5:
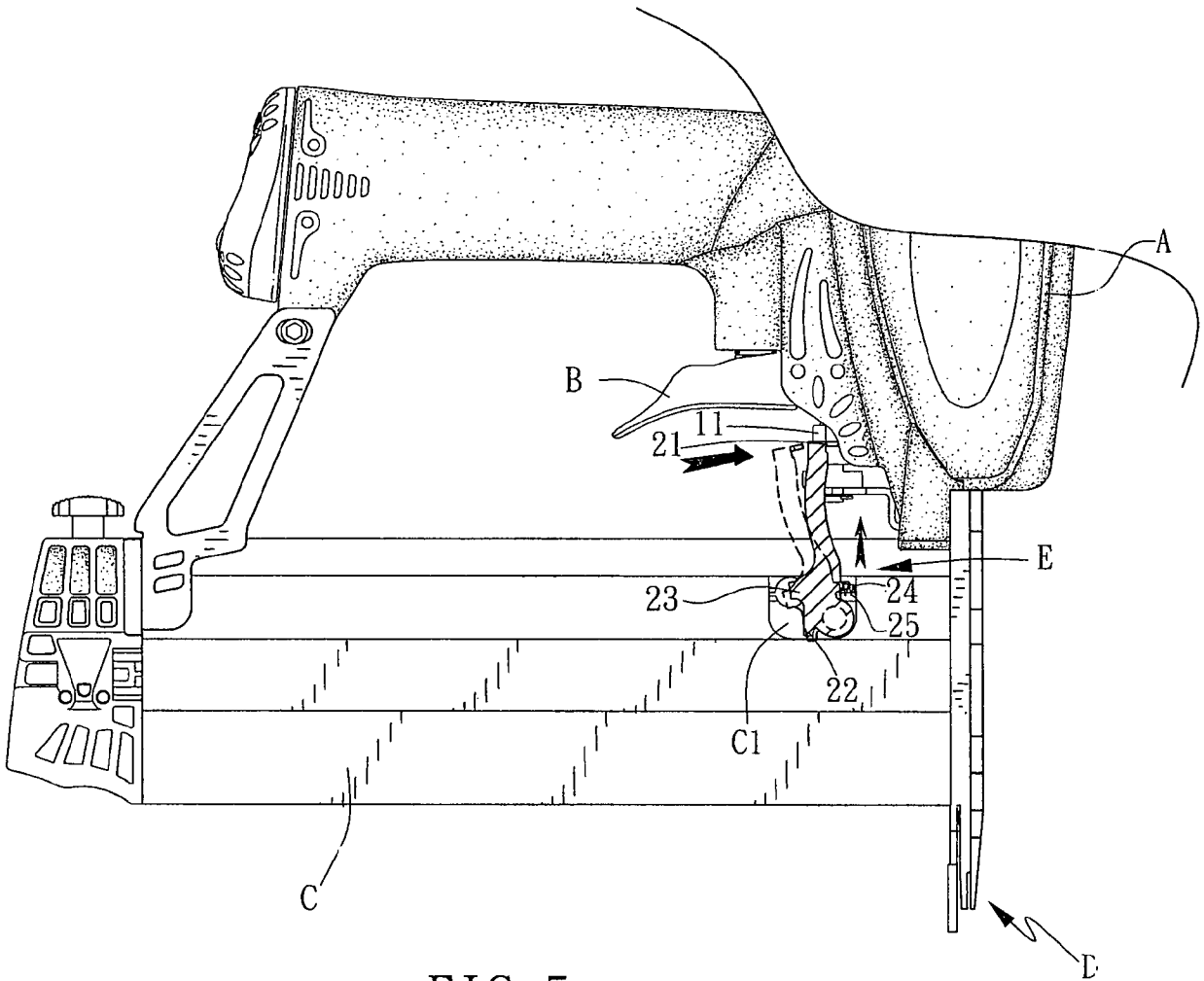
FIG. 5 is a plan view showing the status of use of the present invention.

Referring to FIGS. 4 and 5, an operator places the safety apparatus D against a work object and presses the trigger B to drive the nails inside the fixed magazine C into the work object. Due to the nail pusher C3 urging the nails toward the barrel of the nail gun, when the nails inside the fixed magazine C are getting low, the pushing part 23 of the interlocking piece 20 of the dry firing prevention device E would be pushed by the nail pusher C3 making the hooking part 21 to hook on the setting part 111 of the adjusting assembly 10. As a result, the adjusting assembly 10 is unable to move namely the safety piece 13 is unable to push back so that the trigger B is unable to be pressed and fire the nail. The operator has to open the removable nail loading assembly C2 on the fixed magazine C to load nails, and then the nail pusher C3 is away from the pushing part 23 of the interlocking piece 20. The adjusting assembly 10 is returned to the normal position by means of the elasticity of the elastic element 25 mounted on the protruding part 24 pushing the hooking part 21 of the interlocking piece 20 away from the setting part 111 of the acting piece 11. When the nail gun is placed against the work object, the safety apparatus D would be pushed back and the adjusting assembly 10 would be not in the position of blocking the trigger B, then the trigger B can be pressed and fire the nail.

Figure 6:
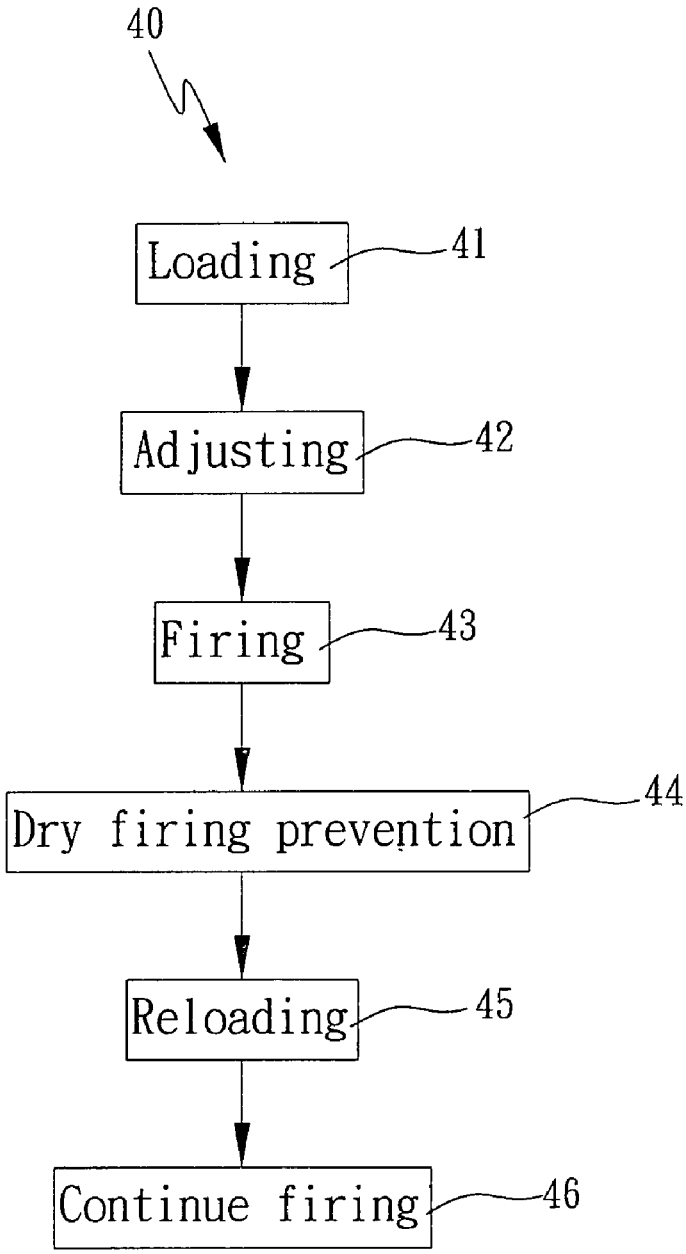
FIG. 6 is a flow chart of the present invention.

Referring to FIG. 6, the dry firing prevention flow chart 40 depicts a procedure as follows.

Loading 41: the operator opens the removable nail loading assembly C2 and loads nails therein, then pushes the removable nail loading assembly C2 back to the fixed magazine C, the nails are urged by the nail pusher C3.

Adjusting 42: the operator places the safety apparatus D against a work object by means of the safety piece 13 of the adjusting assembly 10 of the safety apparatus D pushing the work object, and then adjusts the adjusting piece 12 to the need depth of the work object.

Firing 43: the operator presses the trigger B continuing to drive the nails out of the fixed magazine C into the work object.

Dry firing prevention 44: when the nails inside the fixed magazine C are getting low, the nail pusher C3 on the removable nail loading assembly C2 urges the pushing part 23 of the interlocking piece 20 that is pivotally connected to the locking area C1 of the fixed magazine C to cause the hooking part 21 to hook on the setting part 111 of the adjusting assembly 10, so that the trigger B is unable to be pressed and the nail gun will be protected from dry firing.

Reloading 45: the operator pulls the removable nail loading assembly C2 together with the nail pusher C3 out of the fixed magazine C and reloads nails, and then pushes the removable nail loading assembly C2 together with the nail pusher C3 back to the fixed magazine C to make the fixed magazine C full with nails.

Continue firing 46: the operator can readjust and reuse the nail gun.

Figure 7:
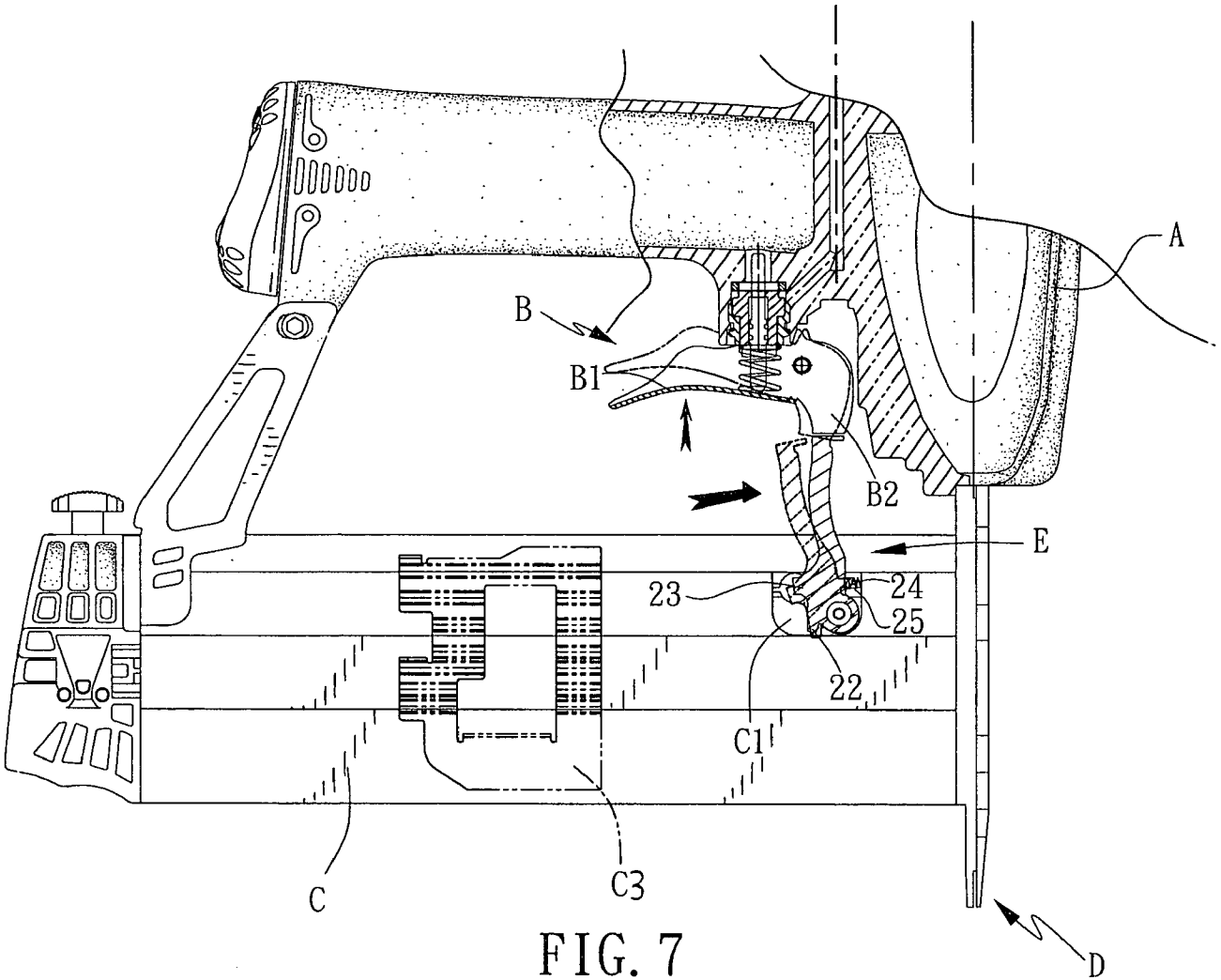
FIG. 7 is a plan view of another embodiment of the present invention.

Referring to FIG. 7, which is another embodiment of the prevent invention. A main body A of a nail gun is equipped with a dry firing prevention device E between a trigger B and a fixed magazine C. The trigger B includes a pressing part B1 that is a device that can be activated by fingers and a propping part B2 that is able to prop against the dry firing prevention device E. The dry firing prevention device E is disposed on a locking area C1 of the fixed magazine C near the trigger B. With the cooperation of the propping part B2 of the trigger B and the dry firing prevention device E on the locking area C1, when a nail pusher C3 inside the fixed magazine C pushes the nails until where last few nails are left, on end of the dry firing prevention device E props against the propping part B2 of the trigger B, so that the pressing part B1 of the trigger B is unable to be pressed to fire the nail. As a result, the inner structure of the nail gun and the firing device can be protected from damage.

The fixed components, nails and the firing device are all conventional mechanisms and instruments, so that further description is superfluous.

While we have shown and described the embodiment in accordance with the present invention, it should be clear to those skilled in the art that further embodiments may be made without departing from the scope of the present invention.

What is claimed is:

1. A dry firing prevention device of a nail gun, in which a main body of the nail gun equipped with a safety apparatus and a dry firing prevention device between a trigger and a fixed magazine, the fixed magazine including a locking area, a removable nail loading assembly and a nail pusher, the locking area including a fixing part and a receiving part for fixing the dry firing prevention device, the removable nail loading assembly for receiving the nail pusher and nails, wherein:

the safety apparatus has an adjusting assembly including an acting piece, an adjusting piece, a safety piece and an elastic piece, the acting piece having a threaded locking part for receiving the adjusting piece, a setting part for engaging with the dry firing prevention device, an inserting part for receiving the elastic piece and a penetrating part for receiving a fastener, the adjusting piece including an adjusting element, a threaded part for inserting into the threaded locking part of the acting piece and a locking part for inserting through the safety piece, the safety piece having an aperture for receiving the locking part of the adjusting piece; and the dry firing prevention device having an interlocking piece including a hooking part, a retaining part, a pushing part and a protruding part inserted to an elastic element, the interlocking piece being connected to the fixed magazine and hooked with the safety apparatus.

2. The dry firing prevention device as claimed in claim 1, wherein the threaded locking part of the acting piece is engaged with the threaded part of the adjusting piece.

3. The dry firing prevention device as claimed in claim 1, wherein the penetrating part of the acting piece is penetrated by the fastener and locked in position near the trigger.

4. The dry firing prevention device as claimed in claim 1, wherein the inserting part of the acting piece is mounted on the elastic element.

5. The dry firing prevention device as claimed in claim 1, wherein the setting part of the acting piece is for receiving the hooking part of the interlocking piece.

6. The dry firing prevention device as claimed in claim 1, wherein the pushing part of the interlocking piece is inserted into the receiving part of the locking area of the fixed magazine and able to contact with the nail pusher of the removable nail loading assembly.

7. The dry firing prevention device as claimed in claim 1, wherein the retaining part of the interlocking piece is propped against the fixed magazine inside the locking area.

8. The dry firing prevention device as claimed in claim 1, wherein the protruding part of the interlocking piece is inserted into the elastic element compressed against the fixed magazine inside the locking area.

9. A dry firing prevention device of a nail gun, in which a main body of the nail gun equipped with a safety apparatus and a dry firing prevention device between a trigger and a fixed magazine, the fixed magazine including a locking area, a removable nail loading assembly and a nail pusher, the locking area including a fixing part and a receiving part, wherein:

the safety apparatus has an adjusting assembly including an acting piece, an adjusting piece, a safety piece and an elastic piece, the acting piece having a threaded locking part for receiving the adjusting piece, a setting part for engaging with the dry firing prevention device, an inserting part for receiving the elastic piece and a penetrating part for receiving a fastener, the adjusting piece including an adjusting element, a threaded part for inserting into the threaded locking part of the acting piece and a locking part for inserting through the safety piece, the safety piece having an aperture for receiving the locking part of the adjusting piece locked by a locking element, the adjusting assembly connected with the trigger and the dry firing prevention device.

10. The dry firing prevention device as claimed in claim 9, wherein the threaded locking part of the acting piece is engaged with the threaded part of the adjusting piece.

11. The dry firing prevention device as claimed in claim 9, wherein the penetrating part of the acting piece is penetrated by the fastener and locked in position near the trigger.

12. The dry firing prevention device as claimed in claim 9, wherein the inserting part of the acting piece is mounted on the elastic element.

13. The dry firing prevention device as claimed in claim 9, wherein the locking area is equipped with the dry firing prevention device.

14. The dry firing prevention device as claimed in claim 13, wherein the dry firing prevention device has an interlocking piece including a hooking part, a retaining part, a pushing part and a protruding part inserted to an elastic element.

15. The dry firing prevention device as claimed in claim 14, wherein the interlocking piece of the dry firing prevention device is pivotally connected to the fixing part of the locking area of the fixed magazine.

16. The dry firing prevention device as claimed in claim 14, wherein the pushing part of the interlocking piece is inserted into the receiving part of the locking area of the fixed magazine and able to contact with the nail pusher of the removable nail loading assembly.

17. The dry firing prevention device as claimed in claim 14, wherein the retaining part of the interlocking piece is propped against the fixed magazine inside the locking area.

18. The dry firing prevention device as claimed in 14, wherein the setting part of the acting piece is for receiving the hooking part of the interlocking piece.

19. The dry firing prevention device as claimed in claim 14, wherein the protruding part of the interlocking piece is inserted into the elastic element compressed against the fixed magazine inside the locking area.

* * * * *